United States Patent [19]

Ito et al.

[11] Patent Number: 4,509,470

[45] Date of Patent: Apr. 9, 1985

[54] FUEL INJECTION PUMP

[75] Inventors: Satoru Ito; Masatoshi Endo, both of Higashi Matsuyama, Japan

[73] Assignee: Diesel Kiki Company, Ltd., Tokyo, Japan

[21] Appl. No.: 353,130

[22] Filed: Mar. 1, 1982

[30] Foreign Application Priority Data

Mar. 12. 1981 [JP] Japan ..... 56-34670[U]

[51] Int. Cl.[3] ..... F02M 39/00; F02D 31/00

[52] U.S. Cl. ..... 123/179 L; 123/502; 123/449

[58] Field of Search ..... 123/502, 179 L, 501, 123/500, 449

[56] References Cited

U.S. PATENT DOCUMENTS 4.177.775 11/1979 Hofer ..... 123/502

4.312.312 1/1982 Hofer ..... 123/502

*Primary Examiner*—Tony M. Argenbright

*Assistant Examiner*—Carl Stuart Miller

*Attorney, Agent, or Firm*—Jordan and Hamburg

[57] ABSTRACT

A fuel injection advance angle control member (28) and a fuel control member (52) are manually and simultaneously controllable to increase the fuel injection angle and the volume of fuel injection, before an engine is started. A knob (112) is located in a position accessible for manipulation. A wire (110) connects the knob (112) to cams (102, 82) which are associated with the fuel injection advance angle control member (28) and the fuel control member (52), respectively. The connection between the knob (112) and the cam (102) includes a spring (210, 300) which is yieldable when the knob (112) is pulled, so that a reaction force counteracting the pulling effort is reduced to promote manipulation with a minimum of effort. Upon an engine start, the resilient force accumulated in the spring (210, 300) is released to move the member (28) to a desired advanced angle position through the cam (102).

2 Claims, 7 Drawing Figures

FUEL INJECTION PUMP

BACKGROUND OF THE INVENTION

The present invention relates to a fuel injection pump for an internal combustion engine which may be, but is not limited to, the distribution type.

Fuel injection systems are popular in the field of internal combustion engines due to their many advantages, especially where adapted to combustion ignition or Diesel engines. Typical of such systems is the distribution system in which a plunger is simultaneously rotated and reciprocated to pump fuel to injection nozzles of a number of engine cylinders.

In a known distribution type fuel injection pump, a fuel control sleeve is positioned by flyweights to control the amount of fuel injection in accordance with engine speed. The flyweights urge a governor rod toward a tension lever as the engine speed increases.

A problem has existed in this type of pump in that a stroke of the governor rod available with the flyweights is limited due to the inherent arrangement and, thus, zero fuel injection is unachievable at the no-load maximum engine speed condition should a substantial stroke of the governor rod be employed for increasing the amount of fuel injection for a start of engine operation.

Meanwhile, a fuel injection advance angle control member of the pump is generally designed to move to increase a fuel injection advance angle as the engine speed increases. This gives rise to another problem that the angle cannot be increased for a start of engine operation.

SUMMARY OF THE INVENTION

A fuel injection pump embodying the present invention includes a fuel injection advance angle control member which is controlled to increase the angle as an engine speed is increased, a fuel control member which is controlled to decrease the amount of fuel injection as an engine speed is increased, a knob located in a position accessible for manipulation, and an operative connection between the knob and at least the fuel injection advance angle control member for permitting said member to be manually controlled through the knob to increase the angle before the engine is started.

In accordance with the present invention, a fuel injection advance angle control member and a fuel control member are manually and simultaneously controllable to increase the fuel injection angle and the volume of fuel injection, before an engine is started. A knob is located in a position accessible for manipulation. A wire connects the knob to cams which are associated with the fuel injection advance angle control member and the fuel control member, respectively. The connection between the knob and the cam associated with the advance angle control member includes a spring which is yieldable when the knob is pulled, so that a reaction force counteracting the pulling effort is reduced to promote manipulation with a minimum of effort. Upon an engine start, the resilient force accumulated in the spring is released to move the member to a desired advanced angle position through the cam.

It is an object of the present invention to provide a fuel injection pump which permits the fuel injection timing to be advanced and the amount of fuel injection to be increased manually at the same time for a start of an engine.

It is another object of the present invention to provide a unique operative connection for the manual control which minimizes an effort necessary for the manipulation.

It is another object of the present invention to provide a generally improved fuel injection pump.

Other objects, together with the foregoing, are attained in the embodiments described in the following description and illustrated in the accompanying drawings.

DESCRIPTION OF THE PREFERRED EMBODIMENTS

While the fuel injection pump of the present invention is susceptible of numerous physical embodiments, depending upon the environment and requirements of use, substantial numbers of the herein shown and described embodiments have been made, tested and used, and all have performed in an eminently satisfactory manner.

Figure 1:
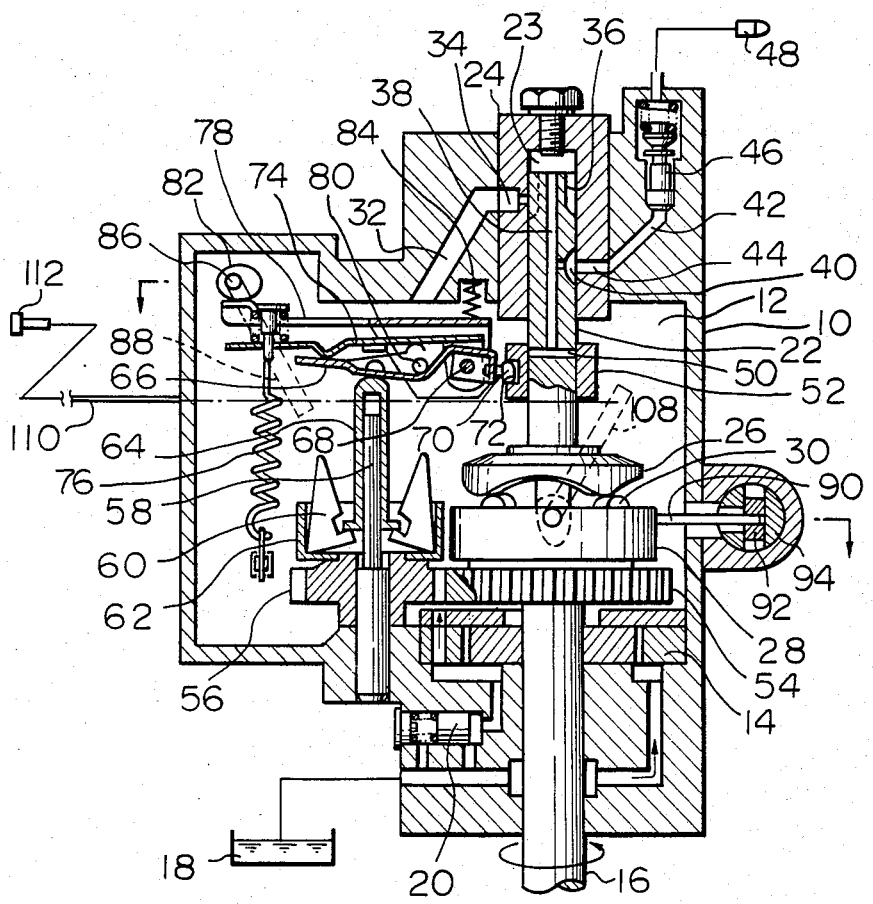
FIG. 1 is a longitudinal section of a fuel injection pump embodying the present invention.
Figure 2:
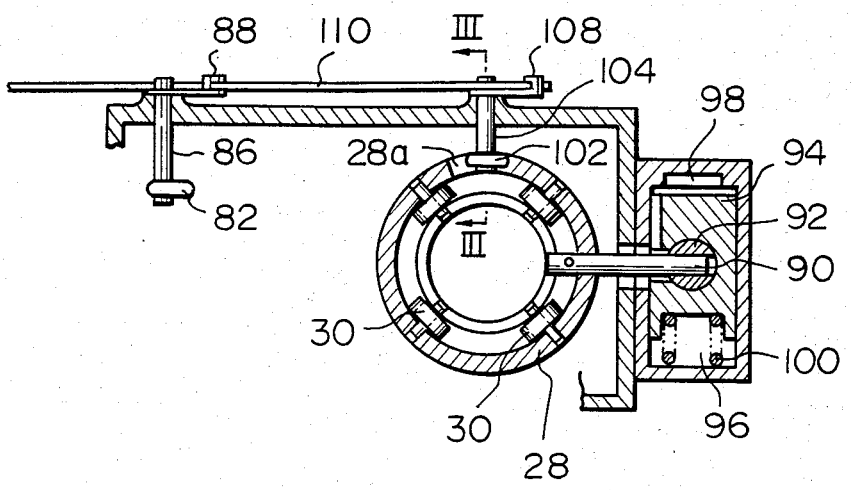
FIG. 2 is a section as seen in a direction indicated by an arrow II—II in FIG. 1.
Figure 3:
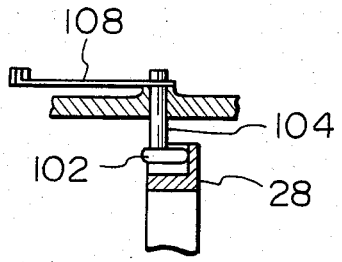
FIG. 3 is a section as seen in a direction indicated by an arrow III—III in FIG. 2.

Referring now to FIGS. 1–3 of the drawing, a fuel injection pump embodying the present invention includes a housing 10 which has a chamber 12 defined therein. A vane pump 14 is disposed inside the housing 10 and mounted on an input shaft 16 which is driven from an engine (now shown). The vane pump 14 sucks and compresses fuel from a tank or reservoir 18 to feed it into the chamber 12 of the housing 10. A pressure control valve 20 is mounted in the housing 10 in order to control the fluid pressure in the chamber 12 in accordance with engine speed in a well known manner. The pressure in the chamber 12 therefore is increased as the engine speed increases.

A piston or plunger 22 is rotatably disposed in a bore 23 of a barrel 24 which is mounted in the housing 10. A cam disc 26 is fixed to the lower end of the piston 22 and urged by a spring (not shown) into engagement with a roller carrier 28. The carrier 28 is in the form of a disc and carries balls or rollers 30 in recesses (not designated) in its upper surface which rollingly engage with the cam 26. The lower surface of the cam 26 is formed with projections (not designated) in a number equal to the number of cylinders of the engine. The cam 26 is in driven connection with the input shaft 16 through a drive disc (not shown). Rotation of the piston 22 causes the cam 26 to ride up and down on the rollers 30 and thereby causes the piston 22 to reciprocate inside the barrel 24.

During a downward (as viewed in FIG. 1) or return stroke of the piston 22, fuel from the chamber 12 flows into the upper closed end of the bore 23 through a passageway 32 formed through the housing 10, a passageway 34 formed through the barrel 24 and one of a plurality of axially extending peripheral grooves 36 formed on the piston 22.

As the piston 22 moves upward during a fuel injection stroke, the lower end of the groove 36 moves above the opening of the passageway 34 so that the passageway 34 no longer communicates with the upper portion of the bore 23. This causes fuel to be compressed and displaced through an axial passageway 38 in the piston 22 and a distribution groove 40 which communicates with the passageway 38 into an outlet passageway 42 formed through the housing 10 via a passageway 44 in the barrel 24. When the pressure in the passageway 42 reaches a sufficiently high value, the fuel is fed through a delivery valve 46 to a fuel injection nozzle 48 and thereby into the engine cylinder.

The piston 22 is further formed with a radial passageway 50 which leads from the axial passageway 38. A sleeve 52 is slidably disposed around the piston 22. The sleeve 52 is positioned so as to cover the passageway 50 and allow the piston 22 to compress fuel in the bore 23 and displace the same through the passageway 42 for fuel injection. However, after the piston 22 has moved upwardly to a certain extent, the opening of the passageway 50 moves above the upper end of the sleeve 52 and thereby communicates the upper portion of the bore 23 with the chamber 12 via the passageways 38 and 50. At this point, the pressure in the bore 23 drops almost instantaneously to the level of the pressure in the chamber 12 and the delivery valve 46 closes. This terminates fuel injection. Thus, it will be seen that the point of fuel injection termination and, therefore, an amount of fuel injection can be controlled by varying the position of the sleeve 52 relative to the piston 22 by a mechanism which will be described hereinafter.

A drive gear 54 is mounted on the input shaft 16 and in driving mesh with a gear 56 which is rotatably mounted on a shaft 58. Flyweights 60 are received in a pocket member which is fixedly carried on the gear 56. Rotation of the input shaft 16 is thus imparted to the flyweights 60 via the gears 54, 56 and pocket member 62. The flyweights 60 in rotation cause a governor sleeve 64 to be moved upwardly around the shaft 58 to an extent which depends on the engine speed.

A lever 66 is rotatably mounted on a pin 68 and opposed by the top of the governor sleeve 64 from below. One end of the lever 66 carries a ball 70 which fits in a socket 72 formed in the control sleeve 52. The lever 66 at the other end is resiliently engaged by a tension lever 74 which is in turn urged by a governor spring 76.

As the flyweights 60 are moved radially outwardly away from each other by the pocket member 62 in accordance with increasing engine speed, they lift the governor sleeve 64 to transmit a centrifugal force related with the engine speed to the lever 66. This moves the lever 66 clockwise about the pin 68 as viewed in FIG. 1 and thereby lower the sleeve 52 relative to the piston 22 to reduce the amount of fuel injection.

A corrector lever 78 is rotatably supported by a pin 80 which is in turn fixed to the housing 10. The corrector lever 78 carries at one end the pin 68 around which the lever 66 is rotatable and, at the other end, it is engaged by an eccentric cam 82. A spring 84 is positioned between the housing 10 and one end of the corrector lever 78 to urge the latter downwardly. A shaft 86 extends axially from the cam 82 to project outwardly from the housing 10. Outside the housing 10, the shaft 86 carries an arm 88 which is movable to vary the position of the corrector lever 78 through the cam 82 on the shaft 86.

An arm 90 extends radially outwardly from the roller carrier 28 which is rotatably positioned in the housing 10 in concentric relation with the input shaft 16. The free end of the arm 90 is engaged with a cylindrical member 92 which is rotatably received in a piston 94. The piston 94 is slidably within a bore formed in a member (not designated) integral with the housing 10. The piston 94 defines a spring chamber 96 and a fluid chamber 98 at its opposite ends in cooperation with the adjacent end walls of the bore, respectively. The spring chamber 96 accommodates a spring 100 therein while the fluid chamber 98 is held in communication with the chamber 12 of the housing 10.

A relation between the force of the spring 100 and the fluid pressure communicated from the chamber 12 to the chamber 98 determines an axial position of the piston 94 which in turn determines an angular position of the roller carrier 28 through the arm 90. A change in the angular position of the roller carrier 28 causes a change in the angular position at which the cam disc 26 engages with the rollers 30 and, eventually, a relative change in the relationship between the angular phase of the input shaft 16 and the above-mentioned angular position of the cam disc 26 engaging with the rollers 30, i.e. operating position of the piston 22. As a result, the fuel injection timing is varied relative to the rotation of the input shaft 16. In the illustrated embodiment, when the piston 94 is moved upwardly in FIG. 2 by a fluid pressure against the action of the spring 100, the roller carrier 28 will be rotated clockwise through the arm 90 to advance the injection timing.

An eccentric cam 102 is also engaged with the roller carrier 28. A shaft 104 extends axially from the cam 102 to project outwardly from the housing 10. Outside the housing 10, the shaft 104 carries an arm 108 which is movable to vary the angular position of the roller carrier 28 through the cam 102.

The arm 88 associated with the cam 82 and the arm 108 associated with the cam 102 are commonly connected with a wire 110. The wire 110 extends from the fuel injection pump as far as a knob 112 which is accessible for manipulation.

Before a start of engine operation, when the operator pulls the knob 112 and thereby the wire 110 connected therewith, the arm 88 is rotated clockwise as viewed in FIG. 1 while the arm 108 is rotated counterclockwise at the same time. Then, the cam 82 connected with the arm 88 drives the corrector lever 78 counterclockwise about the pin 80 against the spring 36. This shifts the pin 68 on the corrector lever 78 so that the sleeve 52 is raised relative to the piston 22 through the lever 66, resulting in an increase in the amount of fuel injection from the fuel injector 48.

The counterclockwise rotation of the arm 108 brings the cam 102 into contact with the roller carrier 28 to move it clockwise as viewed in FIG. 2 against the bias of the spring 100 and thereby advance the injection timing.

In this manner, an increased amount of fuel injection and an advanced injection timing can be provided simultaneously at a start of engine operation with the pump held inoperative, merely by manipulating the knob 112 which connects to the arms 88 and 108 via the wire 110.

When the knob 112 is returned to its inoperative or depressed position, the pump will be operated in a usual mode. Under this condition, the roller carrier 28 is allowed to be moved without any interference by the piston 94 since a play is defined in a notch 28*a* of the roller carrier 28 at one side of the cam 46.

Figure 4:
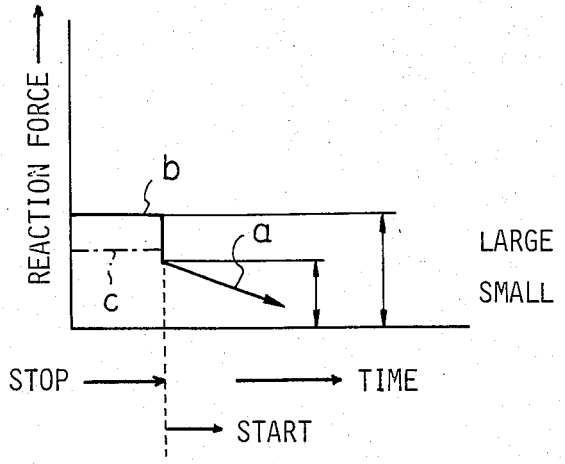
FIG. 4 is a graph showing a variation in a reaction force which acts on a manually operated knob.

Now, when the knob 112 is pulled manually to rotate the arm 108 counterclockwise in FIG. 2, a reaction force acts on the knob 112. FIG. 4 is a graph showing a variation of the reaction force before and after the fuel injection pump is started to operate the engine. After a start of pumping operation, the reaction force remains relatively small as indicated by a line a in FIG. 4, partly because the frictional resistance in the engaging portions of the roller carrier 28 grows less and partly because a force in the injection timing advancing direction acts on the roller carrier 28 due to the action of the piston 94. However, while the pumping operation is stopped, the resistance to the movement of the roller carrier 28 in the advancing direction is substantial and reflected by a substantial reaction force as indicated by a line b in FIG. 4. Such a large reaction force cannot be overcome unless the operator exerts a sufficient and disproportionate pulling force on the knob 112. Additionally, at the time when the pulling force exceeds the reaction force, the rod 112 is moved all of a sudden from its standstill, imparting a shock to the operator's hand.

A second embodiment of the present invention which is improved to preclude the above drawback will be described with reference to FIGS. 5 and 6.

Figure 5:
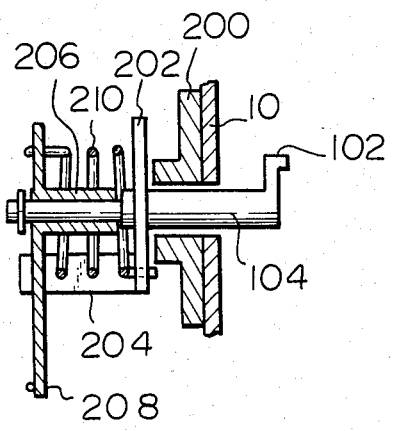
FIG. 5 is a fragmentary section of a second embodiment of the present invention.
Figure 6:
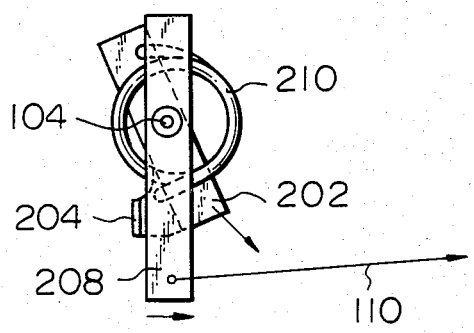
FIG. 6 is a plan view of the arrangement shown in FIG. 5.

In FIGS. 5 and 6, the shaft 104 having the cam 102 therewith is journalled to the housing 10 by a bearing 200. A lever 202 is secured to that portion of the shaft 104 projecting outwardly from the housing 10 and is formed at the other end with a flat stop 204 which extends in parallel with the shaft 104. A tubular member 206 is rotatably mounted on a reduced diameter section of the shaft 104. Secured to the tube 206 is an arm 208 which functions in the same way as the lever 108 of the first embodiment. The wire 110 is connected with the other end of the arm 208. By a stop (not shown), the clockwise movement of the arm 208 as viewed in FIG. 6 is limited to the illustrated position.

A characteristic feature of the embodiment shown in FIGS. 5 and 6 consists in winding a spring 210 around the tube 206. The spring 210 is retained at one end by the arm 208 and at the other end by the lever 202, constantly urging the arm 208 into contact with the stop 204.

With this arrangement, when the operator pulls the knob 112 and so the wire 110, a rotating force is imparted to the lever 202 via the compression spring 210 so that the shaft 104 is rotated to in turn rotate the roller carrier 28 in the advancing direction. In detail, before the engine is started, the knob 112 is pulled by a force which should only be large enough to flex the spring 210 and move the knob 112 and corresponds to a reaction force c in FIG. 4. As the engine is started, the reaction force diminishes to the level a of FIG. 4 as previously discussed so that the lever 202 is rotated by the force stored in the spring 210. This allows the roller carrier 28 to be rotated in the advancing direction.

Figure 7:
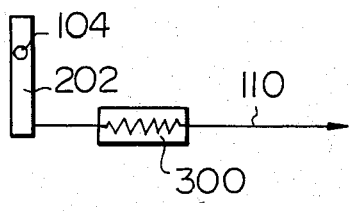
FIG. 7 is a schematic diagram representing a third embodiment of the present invention.

If desired, a spring 300 may be employed to form a part of the length of the wire 110 as illustrated in FIG. 7. A pull of the knob 112 will cause the spring 300 to function in the same way as the spring 210 in moving the roller carrier 28 subsequently with a force stored therein.

In summary, it will be seen that the present invention provides a new and improved fuel injection pump which overcomes the drawbacks inherent in the prior art previously described and promotes the ease of manipulation for a start of engine operation as in choking ordinary gasoline powered engines.

Various modifications will become possible for those skilled in the art after receiving the teachings of the present disclosure without departing from the scope thereof.

What is claimed is:

1. A fuel injection pump for an engine, comprising a fuel injection advance angle control member which is controlled to increase the angle as the speed of the engine is increased, a fuel control member which is controlled to decrease the amount of fuel injection as the engine speed is increased, a knob located in a position accessible for manipulation, an operative connection means between said knob and at least the fuel injection advance angle control member for permitting said member to be manually controlled through said knob to increase the angle before the engine is started, said operative connection means comprising reaction force reducing means for reducing the reaction force which counteracts the force exerted on said knob when manually controlling said fuel injection advance angle control member toward an angle advancing direction, said reaction force reducing means comprising a spring which yields upon manipulation of said knob prior to the start of the engine to store a resilient force therein without moving said fuel injection advance angle control member in the angle advance direction said fuel injection advance angle control member being moved toward the angle advancing direction by said stored resilient force upon starting of the engine, whereby prior to starting of said engine said knob is manually manipulated to apply said stored resilient force to said spring and upon starting of said engine said stored resilient force is applied to move said fuel injection advance angle control member when the force necessary for such movement is reduced due to said starting of the engine.

2. A fuel injection pump for an engine, comprising a fuel injection advance angle control member which is controlled to increase the angle as the speed of the engine is increased, a fuel control member which is controlled to decrease the amount of fuel injection as the engine speed is increased, a knob located in a position accessible for manipulation, an operative connection means between said knob and at least the the fuel injection advance angle control member for permitting said member to be manually controlled through said knob to increase the angle before the engine is started, said operative connection means comprising reaction force reducing means for reducing the reaction force which counteracts the force exerted on said knob when manually controlling said fuel injection advance angle control member toward an angle advancing direction, said reaction force reducing means comprising a helical coil spring which yields upon manipulation of said knob prior to the starting of the engine to store a resilient force therein without moving said fuel injection advance angle control member in the angle advance direction said fuel injection advance angle control member being moved toward the angle advancing direction by said stored resilient force upon starting of the engine, said operative connection means further comprising a wire carrying said knob at one end, an arm connected at one end to said wire, a shaft having a cam at one end for engagement with said fuel injection advance angle control member, said helical coil spring being concentrically disposed relative to said shaft, said arm being rotatably mounted on said shaft, and a lever rigidly mounted on said shaft axially spaced from said arm, said spring being disposed in said space between said lever and said arm and being retained at one end by said lever and at the other end by said arm.

* * * * *